United States Patent [19]

Arentsen

[11] 4,119,159

[45] Oct. 10, 1978

[54] PILE DRIVING APPARATUS

[75] Inventor: Dirk Arentsen, Leiderdorp, Netherlands

[73] Assignee: Hollandsche Beton Greop N.V., Rijswijk, Netherlands

[21] Appl. No.: 841,443

[22] Filed: Oct. 12, 1977

[30] Foreign Application Priority Data

Oct. 18, 1976 [GB] United Kingdom ..... 43219/76

[51] Int. Cl.[2] ..... E02D 7/00

[52] U.S. Cl. ..... 173/133; 405/228

[58] Field of Search ..... 173/128–133; 61/53.5; 279/1 A, 1 L, 95

[56] References Cited

U.S. PATENT DOCUMENTS

| | | | |
|---|---|---|---|
| 1,569,763 | 1/1926 | Litter | 173/128 |
| 2,934,049 | 4/1960 | Spurlin | 173/128 X |
| 3,211,241 | 10/1965 | Kiruchi | 173/131 |
| 3,616,866 | 11/1971 | Verheul et al. | 173/131 |
| 3,828,866 | 8/1974 | Jansz | 173/1 |
| 4,063,599 | 12/1977 | Jansz | 61/53.5 X |

FOREIGN PATENT DOCUMENTS

| | | | |
|---|---|---|---|
| 35,771 | 4/1924 | Norway | 173/133 |
| 458,635 | 9/1975 | U.S.S.R. | 173/130 |

*Primary Examiner*—Lawrence J. Staab

*Attorney, Agent, or Firm*—Brisebois & Kruger

[57] ABSTRACT

The combination of a pile driving apparatus having a hammer operating mechanism mounted above a downwardly extending pile sleeve having an internal cross-section dimensioned to receive the top of a pile of a first diameter, whereby the apparatus may be guided onto and supported on the top of a pile, with an adaptor fitted within the pile sleeve and having an internal cross-section dimensioned to receive the top of a pile of smaller diameter than said first diameter, said adaptor being fabricated as a unit and the adaptor unit and pile sleeve being interconnected preventing withdrawal of the adaptor unit from the pile sleeve. The pile driving apparatus, either with or without the adaptor unit may have a pile sleeve including elongate vertical ribs, having upper and lower ends, spaced around and projecting radially inwardly of the internal surface of the sleeve so that the radially innermost edges of the ribs define the internal cross-section and to facilitate guidance of the apparatus onto the top of a pile the innermost edges of the pile sleeve ribs are shaped such that they diverge progressively from adjacent the lower ends of the pile sleeve ribs to a maximum at the location intermediate the upper and lower ends of the pile sleeve ribs and then converge progressively to adjacent the upper ends of the pile sleeve ribs.

10 Claims, 13 Drawing Figures

PILE DRIVING APPARATUS

BACKGROUND OF THE INVENTION

1. Field of the Invention

This invention relates to pile driving apparatus.

2. Description of the Prior Art

The specification of our U.S. Pat. No. 3,828,866 describes a pile driving apparatus wherein the impulse driving apparatus or hammer is enclosed in a casing, the bottom of which is provided with a downwardly extending tubular guide portion or pile sleeve the lower end of which is provided with an outwardly flaring frusto-conical bell portion. The pile sleeve serves to guide the apparatus on to and to receive the top of the pile. The provision of a pile sleeve, so long as it has sufficient length and its internal dimensions approximately correspond to the external diameter of the pile to be driven, enables the pile driving apparatus to be operated to drive the pile while being supported only by the top of the pile fitting in the pile sleeve with its top resting against the pile cap or anvil which is struck by the hammer blows.

The pile driving apparatus described in the aforesaid specification is specifically for driving piles under subaqueous conditions and has a casing which is closed at its upper end and is provided with means for introducing compressed air into the casing to exclude water therefrom when the casing is submerged. However, similar apparatus of which the casing is not necessarily closed at its upper end is also suitable for use in free air, the apparatus again being supported by the top of the pile to be driven without any separate guide for the pile driving apparatus being necessary.

Pile driving apparatus as described has been made in a range of sizes, some of the larger units for driving tubular steel piles of 7 feet diameter being about 45 feet high over the casing and pile sleeve and weighing about 200 tons. It will be appreciated that such massive pile driving apparatus, or even much smaller sizes, are subject to and deliver heavy blows while being guided on the top of a pile. Thus the pile sleeve must be very strong and is generally reinforced by vertical ribs spaced around and projecting radially inwardly from the internal surface of the sleeve, the innermost edges of the ribs lying on a circle of a diameter approximately equal to the external diameter of the pile. To reduce the risk of the top edge of the tubular steel pile being distorted by impact with the innermost edges of the ribs, cut simply from steel plate, during positioning of the pile sleeve on the pile, the said innermost edges may be widened by securing other plates transversely thereto to provide the ribs with a substantially T-shaped cross-section; the transverse portion of the T may be flat or curved to approximate to the curvature of the pile.

It is seldom that all the piles to be driven are of the same diameter and, as for reasons of cost and other practical considerations it is not feasible, especially when pile driving from a vessel or rig on the ocean, to provide a series of pile driving units equipped with pile sleeves suitable for the different piles or even to provide interchangeable pile sleeves for a common hammer unit, it is the usual practice to provide the unit with a pile sleeve corresponding to the maximum diameter pile to be driven, and to reduce the effective sleeve diameter, as and when required for smaller diameter piles by welding inwardly projecting extension ribs to the innermost edges of the ribs and welding a guide ring to the frusto-conical bell portion of the pile sleeve to provide a lead in to the smaller diameter of the circle on which the innermost edges of the extension ribs lie. Such welding operations are expensive; they have to be carried out in closed-in spaces under hot and difficult conditions by expert welders in order to ensure that the wells can withstand the operating forces without reduction of safety standards. The welded on guide ring is secured so that the effective length of the pile sleeve is not reduced, reduces the lead-in angle of the bell portion and consequently increases the difficulty of guiding the apparatus on to the top of a pile.

SUMMARY OF THE INVENTION

The present invention has for one of its objects, to overcome the above difficulties and to this end consists in providing an adaptor which can be inserted into the pile sleeve to enable the pile driving apparatus to be used with a pile having a smaller diameter and which can be secured in the pile sleeve without welding or with minimal welding operations being necessary.

Another feature of the invention consists in providing a pile sleeve, or a size reducing adaptor therefor, having an internal configuration which reduces the risk of the pile wedging in the pile sleeve while being guided on the pile, and of consequent damage to or deformation of the top of the pile.

DESCRIPTION OF THE PREFERRED EMBODIMENTS

Figure 1:
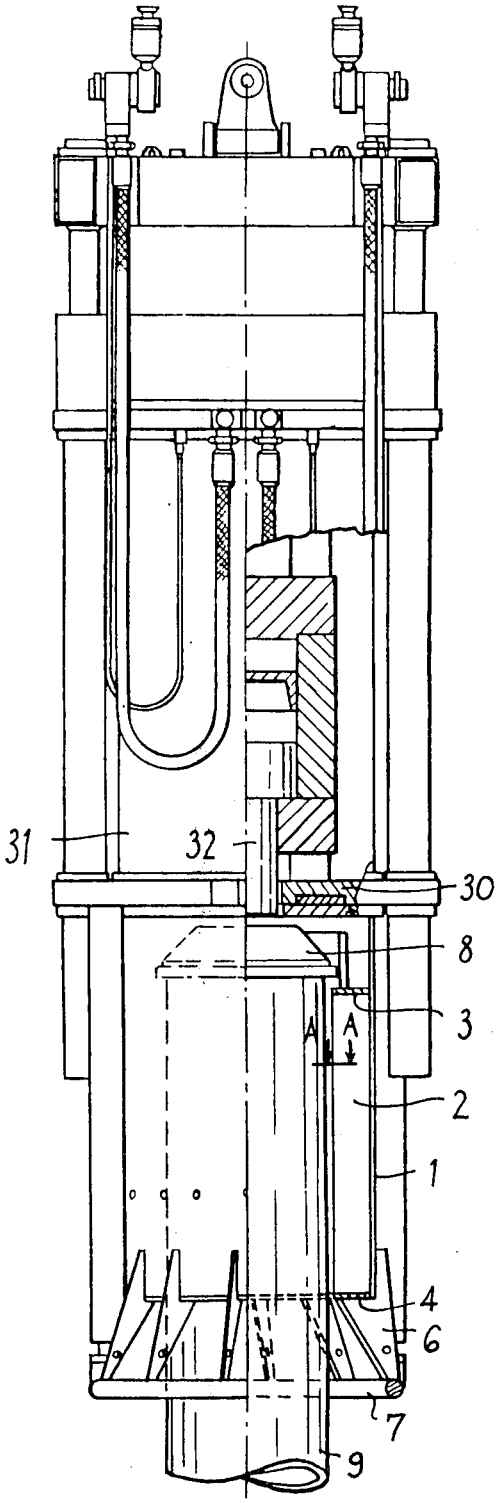
FIG. 1 is a part vertical section through a pile driving apparatus incorporating a pile sleeve as currently constructed, FIGS. *2a, 2b, 2c* and *2d* show alternative cross-sections for the ribs taken along the line A—A of FIG. 1.

FIG. 1 shows a large pile driving apparatus incorporating a pile sleeve according to current construction. The pile sleeve comprises a cylindrical steel shell 1 reinforced by a plurality of vertical steel plate ribs 2 welded to and projecting radially inwardly from the internal surface of the lower portion of the shell 1. There may, for example, be eight ribs 2 which are welded at their upper and lower ends to steel rings 3, 4 respectively also welded to the shell. Extending downwardly from the internal periphery of the ring 4 is an outwardly flaring lead-in portion comprising steel plate ribs 6 which are welded to the shell 1 and ring 4 at their upper ends and are welded at their bottom ends to a steel ring 7. As shown for example in FIG. 3 the lead-in portion may include a frusto-conical steel bell portion 5 welded to the ribs 6 which reinforce it and to the rings 4 and 7.

The upper end of the shell 1 is adapted to be secured, for example by bolts (not shown), to the bottom 30 of the casing 31 enclosing the mechanism for operating the hammer 32 which is adapted to strike the pile cap or anvil 8 captive in the upper part of the pile sleeve.

The innermost edges of the ribs 2 lie on a circle of a diameter equal to that of the internal peripheries of the rings 3 and 4 and approximately equal to the external diameter of the pile to be driven, so that when the pile sleeve is positioned on the pile 9 the pile driving apparatus will be supported by the pile.

Figure 2A:
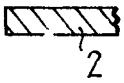
Figure 2B:
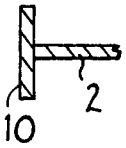
Figure 2C:
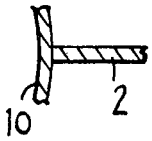
Figure 2D:
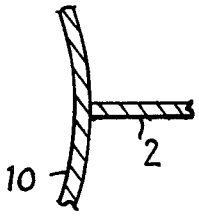

The innermost edges of the ribs 2 may be constituted by the edges of the steel sheet from which the ribs are cut (see FIG. 2*a*) or said edges may have transverse plates 10 welded thereto which may be flat (FIG. 2*b*), curved (FIG. 2*c*) or constitute a complete cylindrical inner shell (FIG. 2*d*).

To position the pile sleeve on the top of a pile, it is necessary to guide the massive pile driving apparatus, which is usually swinging, so that the pile sleeve is brought into axial alignment with the end of the pile. The bell portion 5 serves as a lead-in to the ring 4 and the ribs 2, but the pile can still become wedged by the ribs, with possible damage to or deformation of its top edge, until the pile sleeve has been lowered a sufficient distance down the top of the pile to maintain the necessary axial alignment.

To alleviate this difficulty, according to a feature of this invention, the innermost edges of the ribs 2 are shaped so that the diameter of the circle defined by said innermost edges increases progressively above the upper end of the lead-in bell portion for some distance and then progressively decreases to the upper ends of the ribs where the circle diameter is again approximately the same as that of the upper end of the bell portion.

Figure 3:
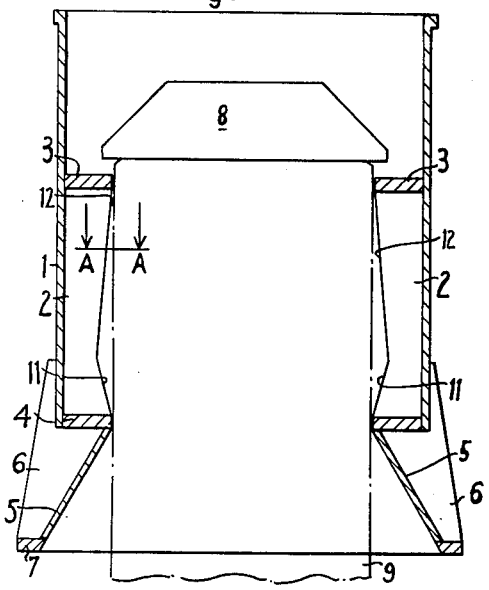
FIG. 3 is a diagrammatic vertical section of a pile sleeve similar to that in FIG. 1 but incorporating a modification according to one feature of the invention.

One embodiment of this feature is shown in FIG. 3 which shows a pile sleeve like that shown in FIG. 1 except that the innermost edges of the ribs 2 have portions 11 which are inclined outwardly from the ring 4 for about one quarter of their height, and then portions 12 inclined inwardly to the internal periphery of the ring 3. With this construction, even if the pile sleeve has its axis inclined to the pile axis as the top of the pile passes through the ring 4, the shaping of the rib edges serves to guide the pile sleeve into alignment with the pile axis, as the pile driving apparatus is lowered on to the pile, with reduced risk of wedging and of damage to or deformation of the top of the steel tubular pile. When the pile is fully inserted, the effective supporting length of the pile sleeve, determined by the distance between the rings 3 and 4, is the same as with the construction of FIG. 1.

Instead of the portions 11, 12 of the rib edges defining a shallow V, they may merge one into the other in a smooth curve. The edges of the ribs may have cross-sections A—A as shown in FIGS. 2*a* to 2*d*.

According to another feature of this invention, a pile sleeve is adapted for mounting on a pile of smaller diameter than that for which the pile sleeve is constructed by means of an adaptor insertable into the pile sleeve through its open bell-portion end and securable therein against relative axial displacement in a manner which eliminates welding or reduces it to minimal proportions.

Figure 4:
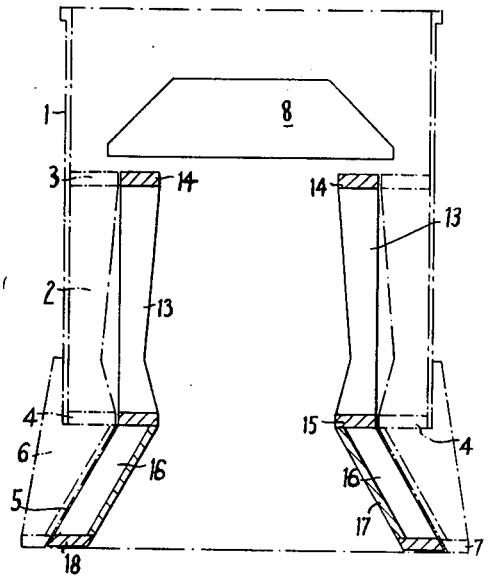
FIG. 4 shows the pile sleeve of FIG. 3 with an adaptor according to one embodiment of the inventon inserted therein.

One embodiment of such an adaptor is shown in FIG. 4. It comprises a plurality of steel plate ribs 13, conveniently equal in number to the number of ribs 2, welded between an upper steel ring 14 and a lower steel ring 15 spaced apart by the same distance as the rings 3 and 4 and having external diameters substantially equal to the internal diameters of the rings 3 and 4. The internal diameters of the rings 14, 15 correspond to the diameter of the pile to be driven. The innermost edges of the ribs 13 may be linear but are preferably shaped as shown to a shallow V-shape for the purpose above mentioned.

The adaptor further comprises steel ribs 16, which may be extensions of the ribs 13, below the ring 15 and inclined outwardly corresponding to the inclination of the frusto-conical surface of the bell portion 5 of the pile sleeve. The innermost edges of the ribs 16 are inclined at substantially the same angle and have welded thereto a frusto-conical bell portion 17 of which the smaller diameter corresponds to the internal diameter of the ring 15. The lower ends of the ribs 17 are welded to a steel ring 18.

It will be clear that the adaptor may be inserted to the position in the pile sleeve shown in FIG. 4 through the open bottom end thereof, and that when so positioned further upward movement will be prevented by engagement of the ribs 16 against the bell portion 5. Horizontal or transverse forces are taken up by engagement of the rings 14, 15 with the rings 3, 4 respectively, alignment of the ribs 13 with the ribs 2 not being necessary. Engagement of the ribs 16 with the bell portion 5 also takes up horizontal forces as well as vertical forces.

Thus, by means of the adaptor described, a pile sleeve can be adapted for use with a pile of smaller diameter simply by inserting the adapter therein and securing it in some way against falling out, while the adapted pile sleeve is being guided into position on top of a pile. Some such ways of securing the adaptor against axial movement out of the pile sleeve are shown in FIGS. 5 to 7.

Figure 5:
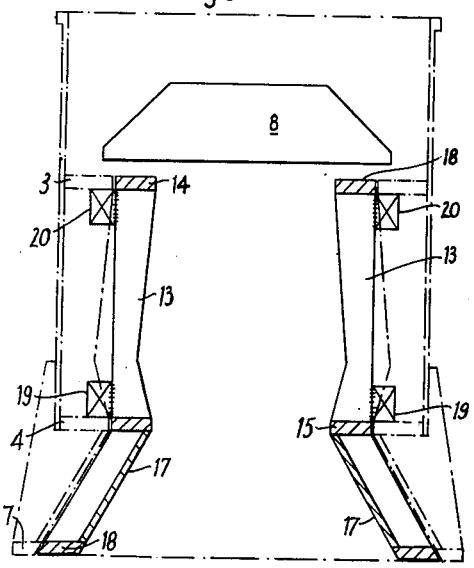
FIGS. 5 to 7 show alternative ways of securing the adaptor of FIG. 4 to the pile sleeve.

In FIG. 5, after the adaptor has been inserted in the pile sleeve, retaining plates or brackets 19 are welded to some or all of the ribs 13 to project above and bear against the upper surface of the ring 4. The brackets 19 may be butt welded to the edges of the ribs 13 or may be welded to the side surfaces thereof. If desired, further brackets 20 may be welded to some or all of the ribs 13 to engage the lower surface of the ring 3 to assist in absorbing upward blows on the adaptor. The brackets 19, 20 can extend between the ribs 2 when they have configurations as shown in FIGS. 2*a*, 2*b* or 2*c*. It is not necessary to weld the brackets to the pile sleeve to prevent the adaptor from turning therein. Where the ribs 2 are provided with a continuous internal wall as shown in FIG. 2*d*, some alternative retaining means must be adopted, for example by welding the ring 18 to the ring 7.

Figure 6:
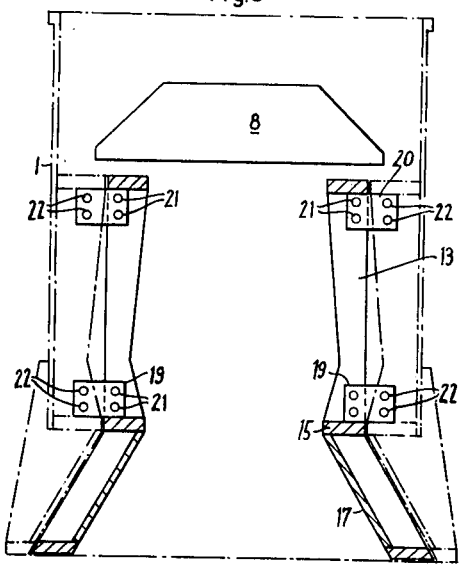
Figure 7:
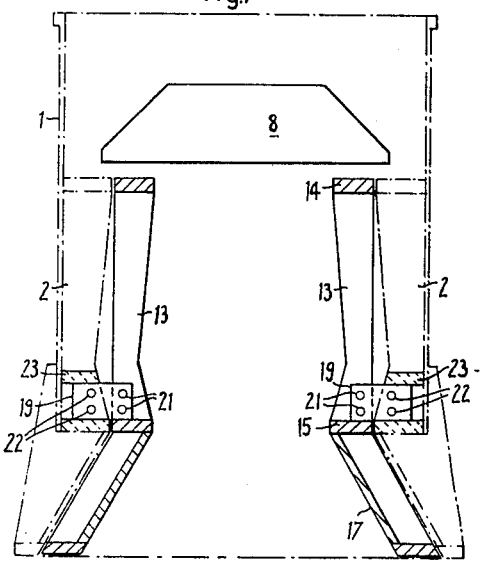

In FIG. 6 the brackets 19, 20 are shown bolted to the ribs 13 and/or the ribs 2 by bolts 21, 22 respectively, thereby eliminating all welding when assembling the adaptor to the pile sleeve. FIG. 7 shows a modification in which the lower brackets 19 also extend below stops 23 welded to the ribs 2 to assist in absorbing upward forces.

Figure 8:
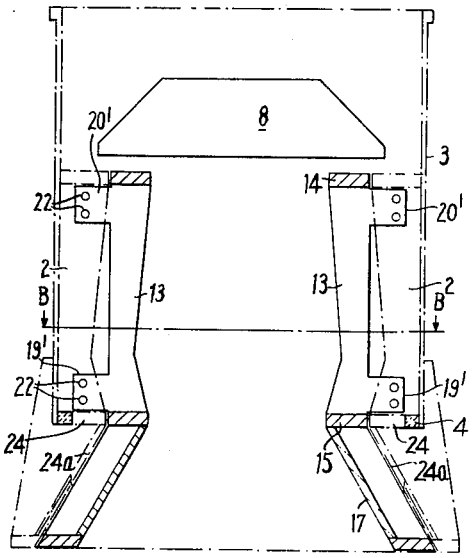
FIG. 8 shows a modification of FIG. 4.
Figure 9:
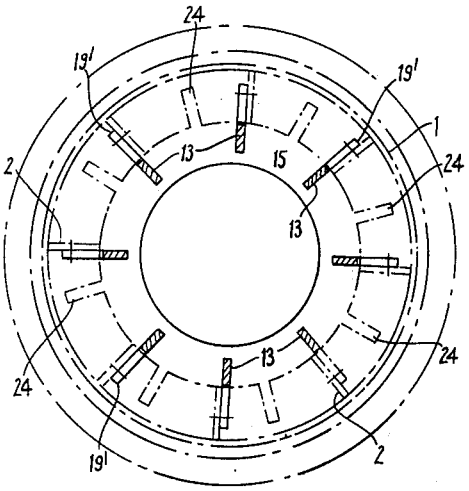
FIG. 9 is a section along the line B—B of FIG. 8.

FIGS. 8 and 9 show another modification in which bracket portions 19' and/or 20' are integral with or welded to the ribs 13 before the adaptor is inserted into the pile sleeve. To permit insertion, radial slots 24, 24*a* are cut in the ring 4 and bell portion 5 respectively of a size and at locations which permit the brackets 20' and/or 19' to pass therethrough, whereafter the adaptor is turned about its axis to bring the brackets 19' out of alignment with the slots 24. The adaptor must be prevented from turning back to bring the brackets in alignment with the slots. This may be effected by bolting the brackets to the ribs 2. Alternatively, one or more stops may be bolted or welded to the upper surface of the ring 4 and/or the undersurface of the ring 3.

Figure 10:
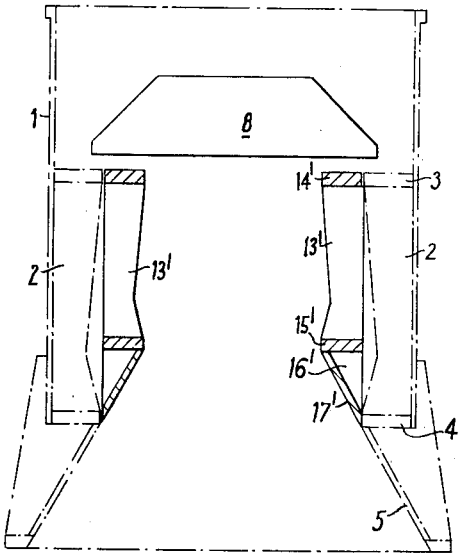
FIG. 10 is a diagrammatic vertical section of another embodiment of an adaptor according to the invention inserted into a pile sleeve according to FIG. 3.

In all the embodiments of the adaptor shown in FIGS. 4 to 9 the effective pile supporting length of the adaptor is the same as that of the pile sleeve. If maintenance of the said effective length is not essential, the alternative construction of adaptor shown in FIG. 10 may be adopted. In this embodiment the ribs 13' are welded to upper and lower rings 14', 15' and the bell portion 17', which is supported by the ribs 16', has its larger diameter equal to the internal diameter of the ring 4 so that its frusto-conical surface forms a continuation of the surface of the bell portion 5 of the pile sleeve. The adaptor may be secured against axial movement in the pile sleeve in any convenient way, for example by the use of brackets as described in connection with the other embodiments.

The ribs 13, 13' of the adaptor may have any of the cross-sectional forms shown in FIGS. *2a* to *2d*.

While particular embodiments have been described, it will be understood that various modifications may be made without departing from the scope of the invention. For example, where the ribs 13 are bolted or otherwise secured to the ribs 2 and in alignment therewith so as to take up the horizontal forces, the ring 14 may be omitted although the provision of the ring or some other annular support for the upper ends of the ribs 13 is of advantage in providing rigidity during assembly of the adaptor in the pile sleeve. Further, as the ribs 16 locate against the ring 4, the ring 15 of the adaptor may also be omitted.

The invention provides an adaptor which can not only be fitted to a pile sleeve without requiring extensive expensive welding operations, but can also be easily removed to restore the pile sleeve for use with piles of a diameter for which it is designed or for fitting an adaptor suitable for another size of pile.

I claim:

1. A pile driving apparatus comprising a hammer and hammer operating mechanism mounted above a downwardly extending pile sleeve having an internal cross-section dimensioned to receive the top of a pile of a first diameter and including outwardly flaring means at its lower end forming a lead-in for said pile, whereby the apparatus may be guided onto and supported on the top of a pile to be driven with the top of the pile resting against an anvil which is struck by the blows of the hammer, in combination with an adaptor fitted within the pile sleeve and having an internal cross-section dimensioned to receive the top of a pile of smaller diameter than said first diameter, said adaptor being fabricated as a unit and comprising a plurality of vertically extending ribs rigidly interconnected by at least one ring and including outwardly flaring means at their lower ends forming a lead-in for said smaller diameter pile, and interconnecting means rigid with at least one of and extending between said adaptor unit and pile sleeve and preventing withdrawal of said adaptor unit from the pile sleeve.

2. The combination as claimed in claim 1, wherein said pile sleeve includes elongate vertical ribs, having upper and lower ends, spaced around and projecting radially inwardly of the internal surface of the sleeve with the radially innermost edges of said ribs defining the said internal cross-section of said sleeve, wherein the lower ends of the pile sleeve ribs are interconnected by a lower ring and wherein the said interconnecting means comprises a plurality of bridging elements which are rigid with at least some of said adaptor unit ribs, said bridging elements projecting into spaces between the pile sleeve ribs and over and against said lower ring of said sleeve.

3. The combination as claimed in claim 2, wherein said bridging elements project beneath and engage against stop members fixed between adjacent ribs of said pile sleeve, whereby to assist in absorbing upward forces acting on said adaptor unit.

4. The combination as claimed in claim 2, wherein the upper ends of said pile sleeve ribs are interconnected by an upper rings and wherein said interconnecting means comprises a plurality of further bridging elements rigid with at least some of said adaptor unit ribs and projecting beneath and engaging against said upper ring whereby to assist in absorbing upward forces acting on said adaptor unit.

5. The combination as claimed in claim 1, wherein said adaptor unit ribs are interconnected at their upper ends by said at least one ring and wherein said interconnecting means comprises a plurality of bridging elements rigid with said pile sleeve and projecting beneath and engaging against the said at least one ring.

6. The combination as claimed in claim 2, wherein the outwardly flaring means of said pile sleeve defines a plurality of vertical slots spaced therearound and aligned respectively with slots defined by the lower ring of said pile sleeve and extending radially between said pile sleeve ribs, said slots providing passages for said bridging elements when said adaptor is fitted in said pile sleeve and said adaptor being initially turnable in said pile sleeve after said fitting, whereby said bridging elements are brought out of alignment with said slots to project over and engage said lower ring between said slots, and means being provided for preventing said adaptor unit from turning relative to said sleeve.

7. The combination as claimed in claim 1, wherein the outwardly flaring means of said adaptor unit forms an inward continuation of the outwardly flaring means of said pile sleeve, whereby to increase the effective length of the lead-in for said smaller diameter pile and decrease the effective pile supporting length of said sleeve.

8. The combination as claimed in claim 1, wherein the innermost edges of said vertical ribs lie on a circle of a diameter approximately equal to the diameter of said smaller diameter pile and wherein guidance of the apparatus onto the top of a pile is facilitated by shaping the innermost edges of said vertical ribs such that the diameter of said circle increases progressively from adjacent the said lower ends of said vertical ribs to a maximum at a location intermediate said lower and upper ends and then decreases progressively to adjacent said upper ends of the vertical ribs.

9. The combination as claimed in claim 1, wherein said pile sleeve includes elongate vertical ribs, having upper and lower ends, spaced around and projecting radially inwardly of the internal surface of the sleeve with the radially innermost edges of said ribs lying on a circle of a diameter approximately equal to the external diameter of said first diameter pile and wherein the innermost edges of said elongate vertical ribs are shaped such that the diameter of said circle increases progressively from adjacent the said lower ends of said pile sleeve ribs to a maximum at a location intermediate said upper and lower ends of said pile sleeve ribs and then decreases progressively to adjacent said upper ends of said pile sleeve ribs.

10. A pile driving apparatus comprising a hammer and hammer operating mechanism mounted above a downwardly extending pile sleeve including elongate vertical ribs, having upper and lower ends, spaced around and projecting radially inwardly of the internal surface of the sleeve, with the radially innermost edges of the ribs lying on a circle of a diameter approximately equal to the external diameter of a pile to be driven, and further including outwardly flaring means extending downwardly of said vertical ribs and forming a lead-in for said pile, whereby the apparatus may be guided onto and supported on the top of the pile to be driven with the top of the pile resting against an anvil which is struck by the blows of the hammer and is located in the pile sleeve adjacent the upper ends of said vertical ribs, wherein guidance of the apparatus onto the top of a pile is facilitated by shaping the innermost edges of said elongate vertical ribs such that the diameter of said circle increases progressively from adjacent the said lower ends of the ribs to a maximum at a location intermediate said lower and upper ends and then decreases progressively to adjacent said upper ends of the ribs.

* * * * *